US008008910B2

(12) United States Patent
Booth et al.

(10) Patent No.: US 8,008,910 B2
(45) Date of Patent: Aug. 30, 2011

(54) STRUT POSITION SENSOR INCLUDING A MAGNET MOUNTED ON AN IDLER GEAR CONTAINED IN A STATOR PORTION, WHICH IS MOVABLE RELATIVE TO A ROTOR PORTION CONNECTED TO THE STRUT, AND A GALVANOMAGNETIC SENSOR IN THE STATOR PORTION FOR DETECTING ANGULAR POSITION OF THE STRUT

(75) Inventors: Thomas Lawson Booth, Birmingham, MI (US); Howard Warren Kuhlman, Rochester Hills, MI (US)

(73) Assignee: Strattec Power Access LLC, Troy, MI (US)

( * ) Notice: Subject to any disclaimer, the term of this patent is extended or adjusted under 35 U.S.C. 154(b) by 317 days.

(21) Appl. No.: 12/070,493

(22) Filed: Feb. 19, 2008

(65) Prior Publication Data

US 2009/0206826 A1 Aug. 20, 2009

(51) Int. Cl.
*G01B 7/30* (2006.01)

(52) U.S. Cl. ..... 324/207.2; 324/207.25

(58) Field of Classification Search ..... 324/174, 324/207.24–207.26, 207.2, 251; 73/514.31, 73/514.39, 862.192, 862.193; 123/612, 617; 702/92–97, 104, 145, 151

See application file for complete search history.

(56) References Cited

U.S. PATENT DOCUMENTS

| | | | | |
|---|---|---|---|---|
| 5,712,478 | A | 1/1998 | Olsson | |
| 5,755,526 | A | 5/1998 | Stanevich | |
| 5,831,554 | A | 11/1998 | Hedayat et al. | |
| 6,092,336 | A | 7/2000 | Wright et al. | |
| 6,252,394 | B1 | 6/2001 | Roze et al. | |
| 6,316,935 | B1 | 11/2001 | Vanzuilen | |
| 6,469,499 | B2 | 10/2002 | Delaporte | |
| 6,675,124 | B2 * | 1/2004 | Koga | 702/151 |
| 6,879,240 | B2 | 4/2005 | Kruse | |
| 6,964,449 | B2 | 11/2005 | Takeda et al. | |
| 7,070,226 | B2 | 7/2006 | Cleland et al. | |
| 7,080,914 | B1 | 7/2006 | Boddy | |

(Continued)

FOREIGN PATENT DOCUMENTS

| | | |
|---|---|---|
| EP | 1059512 | 12/2000 |

(Continued)

OTHER PUBLICATIONS

PCT/US2009/034487 International Search Report and Written Opinion, 7 pages, dated Oct. 12, 2009.

(Continued)

*Primary Examiner* — Bot LeDynh

*Assistant Examiner* — Manuel Hernandez

(74) *Attorney, Agent, or Firm* — Michael Best & Friedrich LLP

(57) ABSTRACT

A power actuator system for a movable vehicle panel such as a lift gate assembly includes a position sensor that detects the pivotal movement of a strut mechanism of the power lift gate assembly relative to the host vehicle. A rotary sensor is coupled directly to an end component of the strut mechanism and provides signals that indicate the total amount of pivotal or rotary movement of the strut mechanism and the lift gate during the opening and closing of the lift gate. The signals provide information to determine the absolute position of the strut and the lift gate for processing in the vehicle's electronic control unit.

18 Claims, 6 Drawing Sheets

U.S. PATENT DOCUMENTS

| | | | | |
|---|---|---|---|---|
| 7,127,369 | B2 | 10/2006 | Fukumura et al. | |
| 7,230,419 | B2 | 6/2007 | Godoy et al. | |
| 7,364,214 | B2 | 4/2008 | Park | |
| 7,405,557 | B2 | 7/2008 | Spratte et al. | |
| 7,570,047 | B2 * | 8/2009 | Stuve et al. | 324/207.2 |
| 2004/0139619 | A1 * | 7/2004 | Tateishi et al. | 33/1 PT |
| 2006/0181108 | A1 | 8/2006 | Cleland et al. | |
| 2006/0273784 | A1 * | 12/2006 | Godoy et al. | 324/207.2 |
| 2007/0262609 | A1 | 11/2007 | King et al. | |
| 2008/0005913 | A1 * | 1/2008 | Kachouh | 33/1 PT |
| 2008/0309324 | A1 * | 12/2008 | Stuve et al. | 324/207.2 |
| 2009/0165745 | A1 * | 7/2009 | Keller et al. | 123/399 |
| 2009/0196682 | A1 | 8/2009 | Kuhlman | |

FOREIGN PATENT DOCUMENTS

| | | |
|---|---|---|
| JP | 10246275 | 9/1998 |
| JP | 2002331837 | 11/2002 |
| KR | 1020040001880 | 1/2004 |
| KR | 10-2005-0115636 | 12/2005 |
| WO | 2005/021295 | 3/2005 |

OTHER PUBLICATIONS

Melexis, MLX90316 Rotary Position Sensor IC, available online at: <http://www.melexis.com/ProdMain.aspx?nID=566>, published May 1, 2007.

Hiligsmann, Vincent, M., "360 Degree Rotary Position Sensing with Novel Hall Effect Sensors", Sensors Magazine, available online at: <http://www.sensorsmag.com/sensors/electric-magnetic/360-degree-rotary-position-sensing-with-novel-hall-effect-se-675?print=1>, Mar. 1, 2006.

Janisch, Josef, "Understanding Integrated Hall Effect Rotary Encoders", Sensors Magazine, available online at: <http://www.sensorsmag.com/sensors/position-presence-proximity/understanding-integrated-hall-effect-rotary-encoders-1254?print=1>, Nov. 1, 2006.

PCT/US2009/034487 International Preliminary Report on Patentability dated Aug. 24, 2010 (5 pages).

PCT/US2010/026405 International Search Report and Written Opinion dated May 11, 2010 (6 pages).

* cited by examiner

STRUT POSITION SENSOR INCLUDING A MAGNET MOUNTED ON AN IDLER GEAR CONTAINED IN A STATOR PORTION, WHICH IS MOVABLE RELATIVE TO A ROTOR PORTION CONNECTED TO THE STRUT, AND A GALVANOMAGNETIC SENSOR IN THE STATOR PORTION FOR DETECTING ANGULAR POSITION OF THE STRUT

RELATED PATENT APPLICATION

This application is related to a copending U.S. patent application Ser. No. 12/012,505, filed 1 Feb. 2008, entitled "Bi-Directional Strut End for Ball Stud Mounted Devices", having a common assignee of interest, the specification of which is expressly incorporated herein by reference.

FIELD OF THE INVENTION

The invention is related to a strut position sensor for application with movable panels such as a rear lift gate of a passenger vehicle.

BACKGROUND OF THE INVENTION

A power actuator system is an option used to power open and close movable panels such as the lift gate or hinged/sliding access doors on certain passenger vehicles, vans and light trucks. The vehicle's computer module can be programmed to control the opening and closing of the lift gate. However, the computer module requires certain information about the lift gate so that the lift gate speed can be controlled and obstacles in the path of the lift gate may be detected. In certain vehicles, the computer module also needs to know the full open position of the lift gate.

Current designs of power lift gate systems typically use a motor speed sensing device to send information to the vehicle computer module. The vehicle's computer module then calculates the lift gate speed and position from that information. If the power to the motor speed sensing sensor is turned off, the position of the lift gate is then unknown. In other current designs and applications, additional switches may be required to detect full open and full closed positions.

SUMMARY OF THE INVENTION

The present invention is a position sensor mounted on a strut employed with a movable panel such as a powered rear lift gate assembly on a vehicle. The position sensor detects the amount of movement of the strut within the rear lift gate assembly to indicate certain characteristics of the lift gate assembly. The system according to the invention includes a strut having ball and socket end connectors. The configuration of the ball and socket end connectors limit certain inherent movement of the strut while providing certain rotational movement and lateral movement of the socket portion of the connector relative to the ball portion of the connector.

A sensor is mounted on one of the end connector components and detects the amount of movement of the strut relative to the ball portion of the end connector during the opening and closing movements of the lift gate. This information is used to measure the location of the lift gate and the speed the lift gate is moving, and further detects the full open and full closed positions of the lift gate.

In one aspect of the invention, the sensor is a rotary position sensor carried at the end of the strut that is attached to the vehicle body. The sensor has a portion supported on the socket portion of the end connector. As the strut rotates to open and close the lift gate, the sensor detects the amount of rotary movement of the strut relative to the ball portion of the end connector.

Other applications of the present invention will become apparent to those skilled in the art when the following description of the preferred embodiment contemplated for practicing the invention is read in conjunction with the accompanying drawings.

These and other features and advantages of this invention will become apparent upon reading the following specification, which, along with the drawings, describes preferred and alternative embodiments of the invention in detail.

BRIEF DESCRIPTION OF THE DRAWINGS

The description herein makes reference to the accompanying drawings wherein like reference numerals refer to like parts throughout the several views, and wherein.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DETAILED DESCRIPTION OF THE PREFERRED EMBODIMENTS

Figure 1:
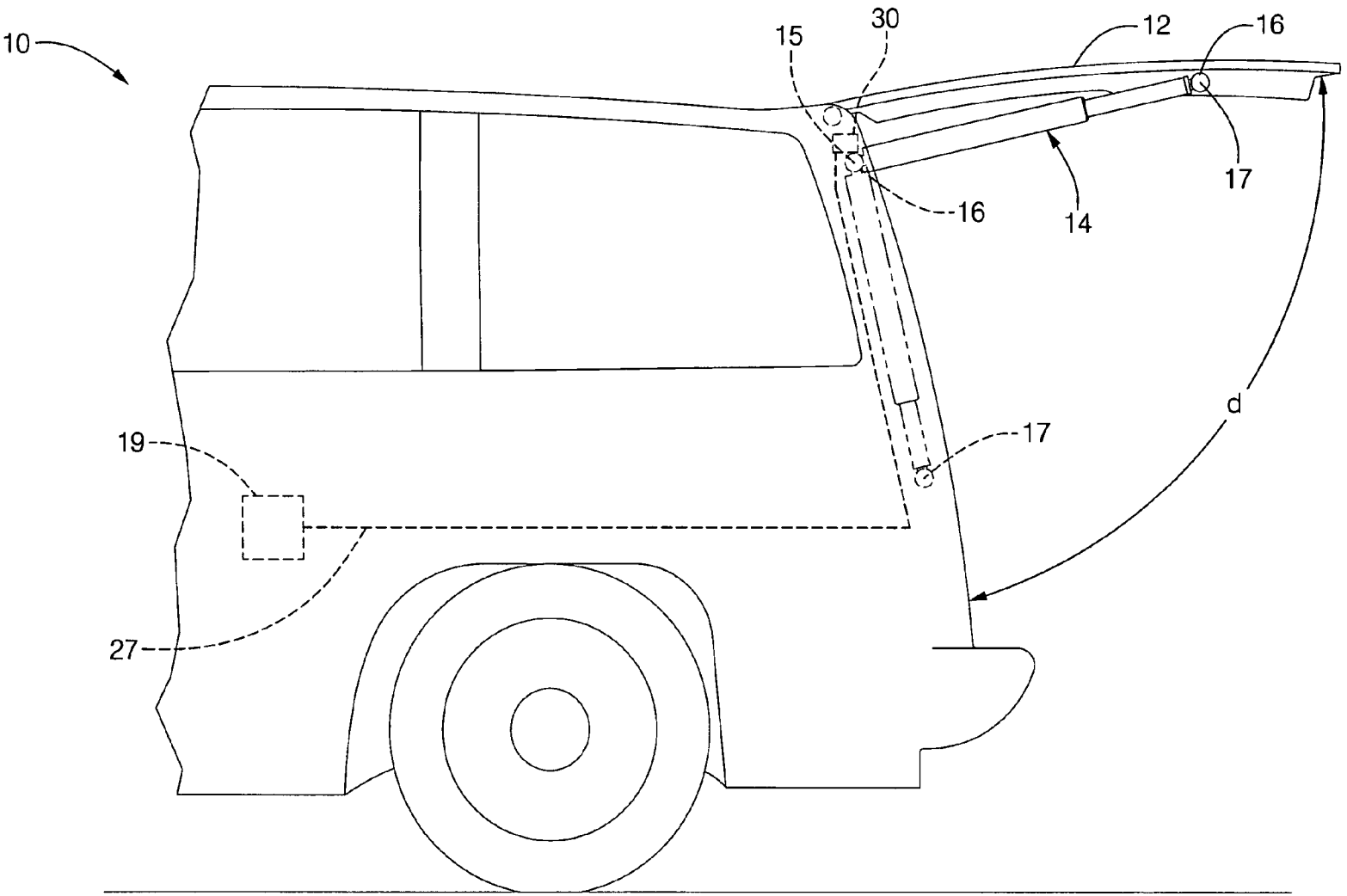
FIG. 1, is a schematic view of a power lift gate having a strut for a vehicle designed according to the present invention.

FIG. 1 schematically illustrates a vehicle 10 having a power rear lift gate 12. A jackscrew 14 can be used as the strut 14 to activate the mechanisms for the lift gate 12 to move between opened and closed positions through an included angle "d". A conventional jackscrew 14 includes a nut (not shown) supported for reciprocal translational movement and against rotational movement. A connector 16 is connected to each end of the jackscrew strut 14 for connecting one end 15 to the vehicle 10 and a second end 17 of the jackscrew strut 14 to the lift gate 12 for accomplishing the raising and lowering of the lift gate 12 and so that certain inherent radial motion of the jackscrew 14 is restricted.

Figure 3:
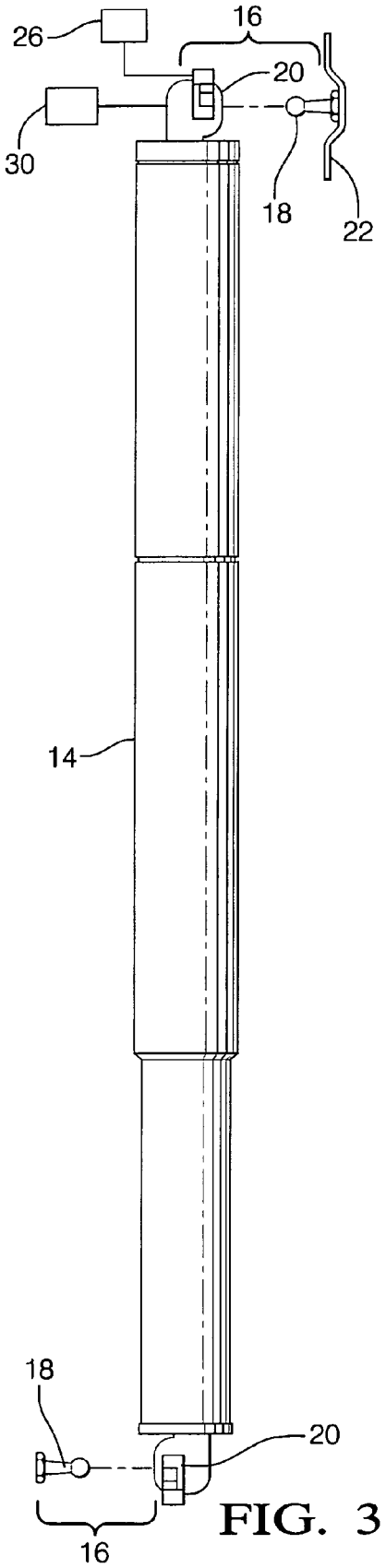
FIG. 3, is an elevational view of the strut having end connectors with a ball stud for mounting on the vehicle and a socket mounted on the strut.
Figure 2:
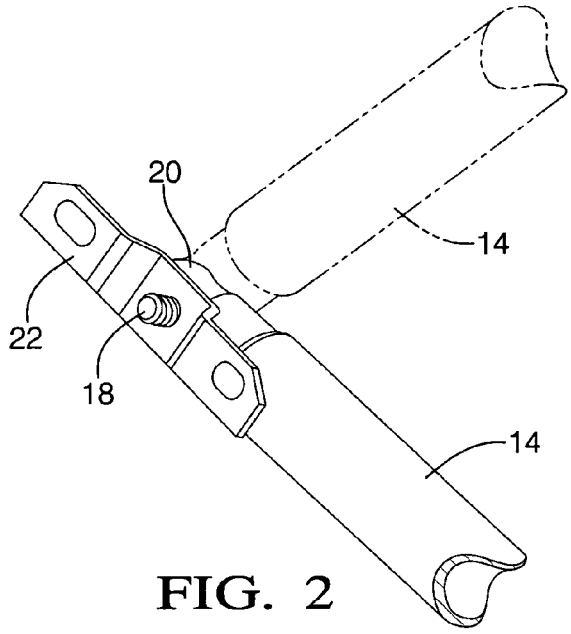
FIG. 2, is a schematic view showing a partial strut in the closed position and the partial strut in phantom in the opened position.
Figure 4:
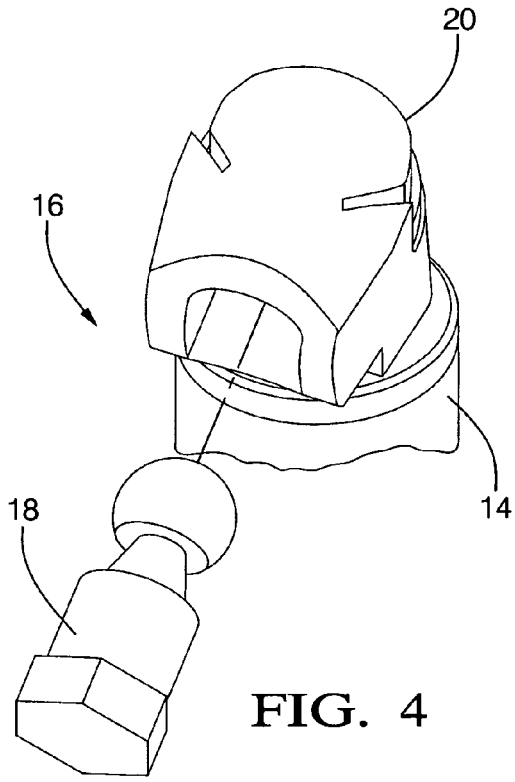
FIG. 4, is a perspective view of one of the end connectors.

Looking at FIGS. 2-4 each connector 16 includes a ball stud 18 mounted to an appropriate location on the vehicle 10 and a ball stud mounting device or ball socket 20 secured to each end of a jackscrew 14. In FIG. 2, a typical application is shown where one ball stud 18 is secured to a bracket 22 at an upper portion of the vehicle 10 adjacent to the opening for the lift gate 12. The other ball stud 18 is mounted to a lower portion of the lift gate 12. Alternatively, it is contemplated that the mounting configuration can be reversed wherein the connector 16 associated with the upper end of the jackscrew strut 14 is secured to an upper portion of the lift gate 12, and the connector 16 associated with the lower end of the jackscrew strut 14 is secured to a lower portion of the vehicle 10.

The configuration of the ball socket connector 16 restricts or prevents certain inherent movement of the jackscrew strut 14. Although the inherent movement of the jackscrew strut 14 requires that certain relative movement of the socket connector 16 be restricted or prevented, the movement of the rear lift gate 12 requires certain movement parameters. In particular, the jackscrew strut 14 for the lift gate 12 should allow at least an 85° angled opening, and preferably a 105° opening about an upper interconnecting hinge point (not illustrated).

The invention includes providing a sensor 30 for detecting the amount of movement of the ball socket 20 and jackscrew strut 14 relative to the associated ball stud 18 mounted to the vehicle 10 during the opening and closing movements of the lift gate 12. The sensor 30 preferably provides signals to an electronic control unit 19. The signals are preferably indicative of the amount of movement of the jackscrew strut 14 during the opening and closing of the lift gate 12. It is understood that one can choose from among commercially available electronic control units or specialized circuitry and software to accomplish the signal processing that results in the collection of the desired data. A communication link 27 is preferably provided to transmit signals from the sensor 30 to the vehicle electronics control unit 19.

While transitioning between the closed and open positions, the lift gate 12 typically travels (rotates) at approximately 15° per second. The preferred position sensor 30 has ¼° resolution. The preferred sensor 30 also detects a full open position within 5° of the actual full open position of the lift gate 12.

In one aspect of the invention, a rotary or angle sensor 30 and a magnet 26 (FIG. 5) are wherein the magnet 26 is fixedly attached to or carried with the ball stud 16 via rigid support structure 28, and the rotary sensor 30 is connected to the ball socket 20. The sensor 30 is supported on the ball socket 20 by a substantially rigid support base 24, which locates the sensor 30 nominally along the centerline X-X of the ball stud 16 in order that the angular rotation of the jackscrew strut 14 relative to the vehicle body 10 can be measured. The angle sensor 30 determines the relative jackscrew strut 14 position and provides the information to the electronic control unit 19 via the communication link 27 in order for the electronic control unit 19 to control the power lift gate mechanism (not illustrated). An output voltage level indicates the instantaneous position of the jackscrew strut 14 and therefore a separate open switch is not required.

Figure 6:
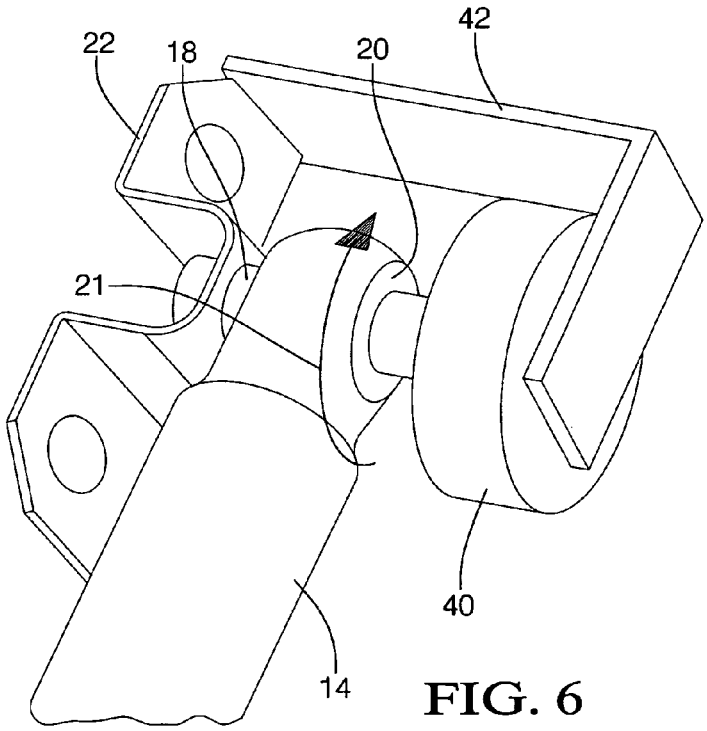
FIG. 6, is another embodiment of a position sensor including a rotary potentiometer attached to a body portion of the vehicle at the end connector of the strut.

In another aspect as shown in FIG. 6, the sensor 40 is a rotary potentiometer 40. The potentiometer 40 is fixedly connected to the vehicle body 10 or the bracket 22 by a second bracket 42 so that the potentiometer 40 is operatively connected to the strut socket body 20. As the jackscrew strut 14 moves through the full travel movement, as indicated by arrow 21, the jackscrew strut 14 will rotate the potentiometer 40 through its operating range. The potentiometer 40 provides full open position information to the electronic control unit 19 when powered up.

Figure 5:
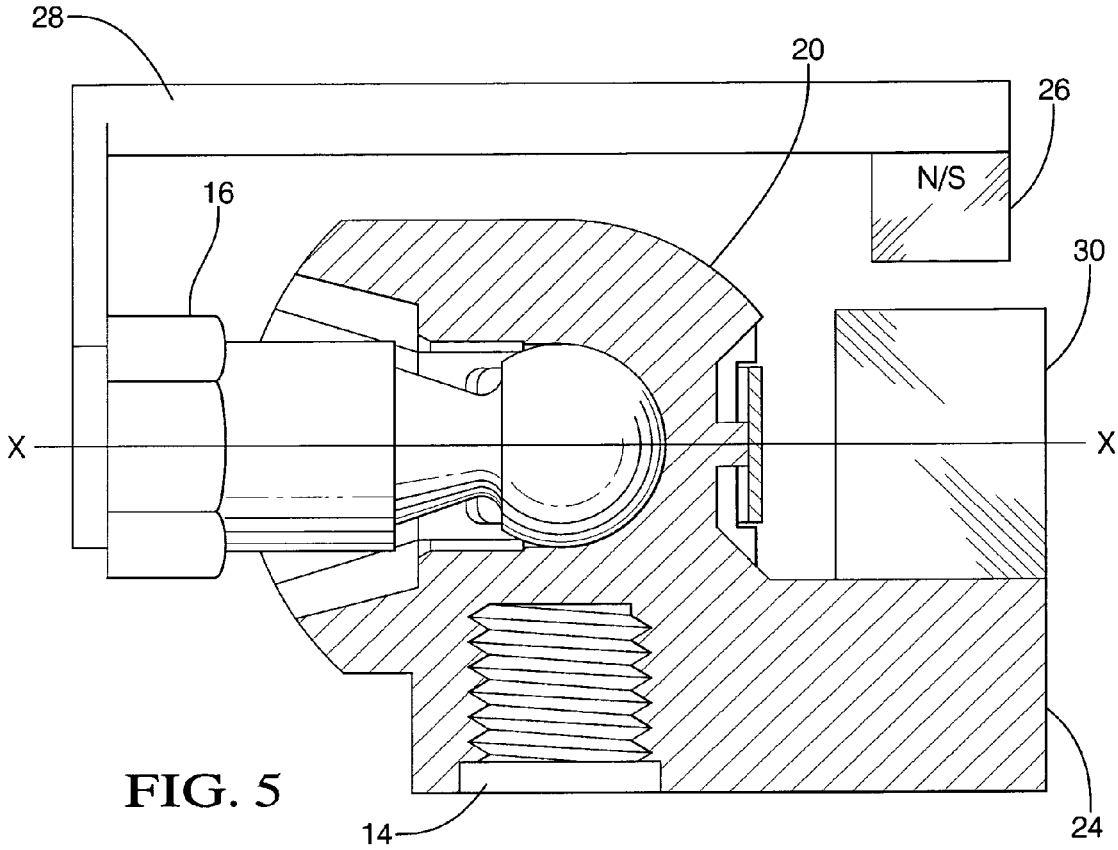
FIG. 5, is a sectional view of the end connector with a rotary sensor shown connected to the ball socket and magnet supported on the ball stud.
Figure 7:
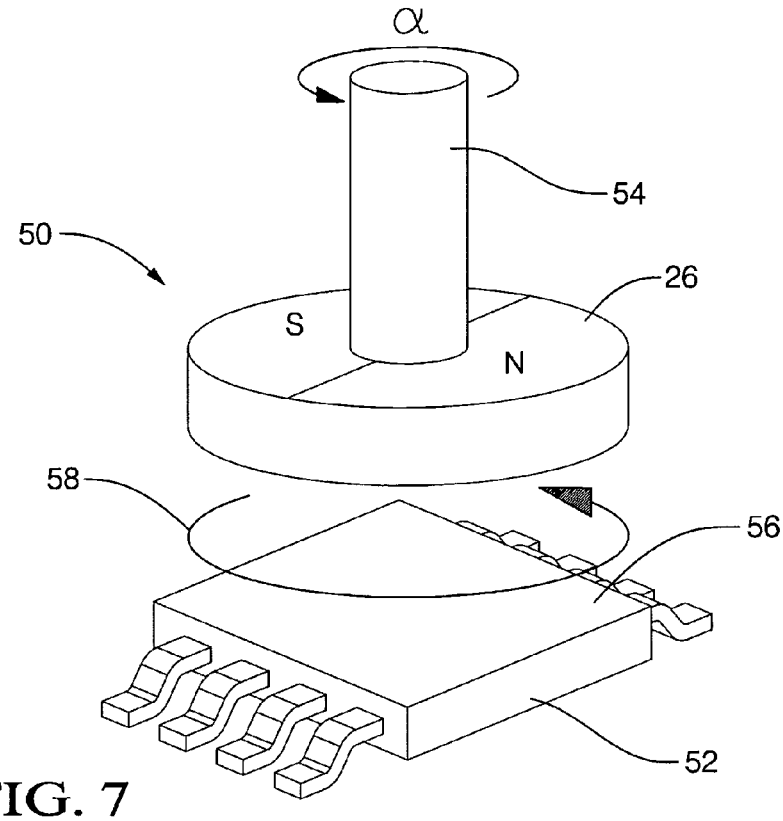
FIG. 7, is an elevational view of a rotary position integrated circuit sensor.

In yet another embodiment shown in FIG. 7, the rotary sensor 30 in FIG. 5 can be replaced with a rotary position integrated circuit (IC) sensor 50 using a Hall Effect integrated circuit 52 and a magnet 26 to detect absolute position of the strut 14. Thus configured, the permanent magnet is carried by structure 54 for limited relative rotation as indicated by arrow α. The radially opposed magnetic poles rotate adjacent the sensing surface 56 of the Hall Effect integrated circuit 52, as indicated by arrow 58, thus conveying the jackscrew strut's instantaneous position information to the electronic control unit 19. The integrated circuit 52 can produce a quadrature signal provided as an analog, pulse width module (PWM) or serial data output. The IC 52 provides the position information to the vehicle electronic control unit 19 when powered up including providing a full open position. Therefore a full open switch is not required.

Figure 8:
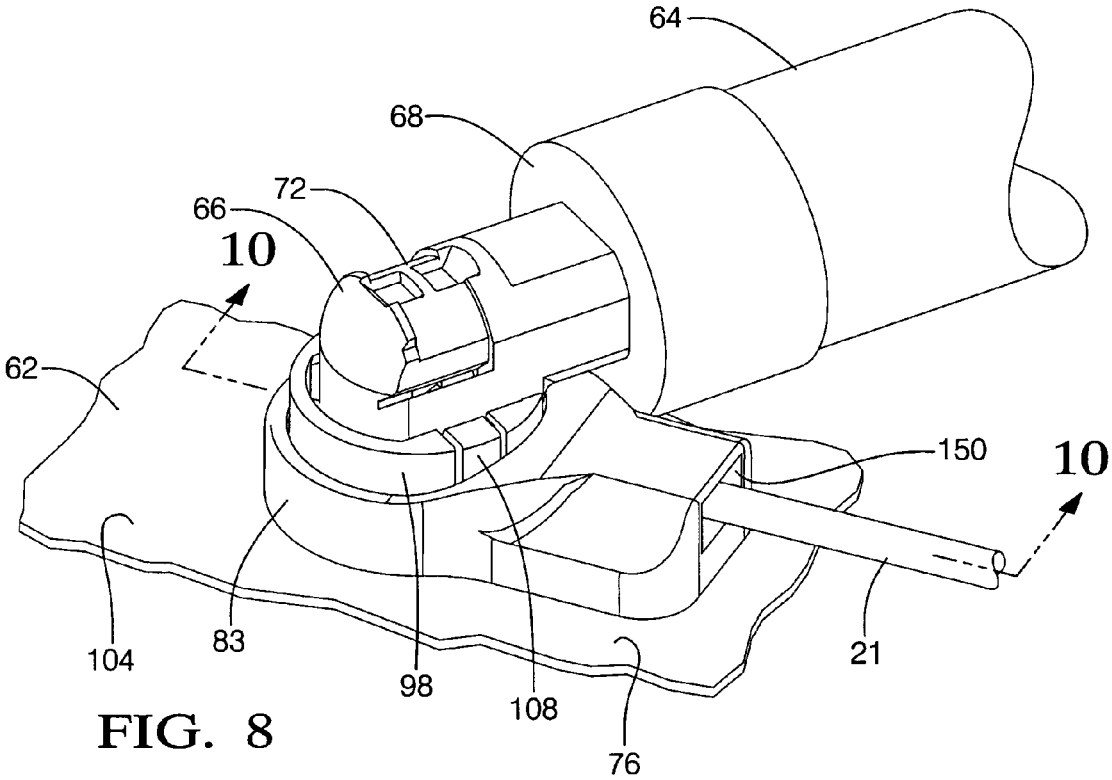
FIG. 8, is a broken, perspective view of an alternative embodiment of the present invention illustrated as installed on a host vehicle.
Figure 9:
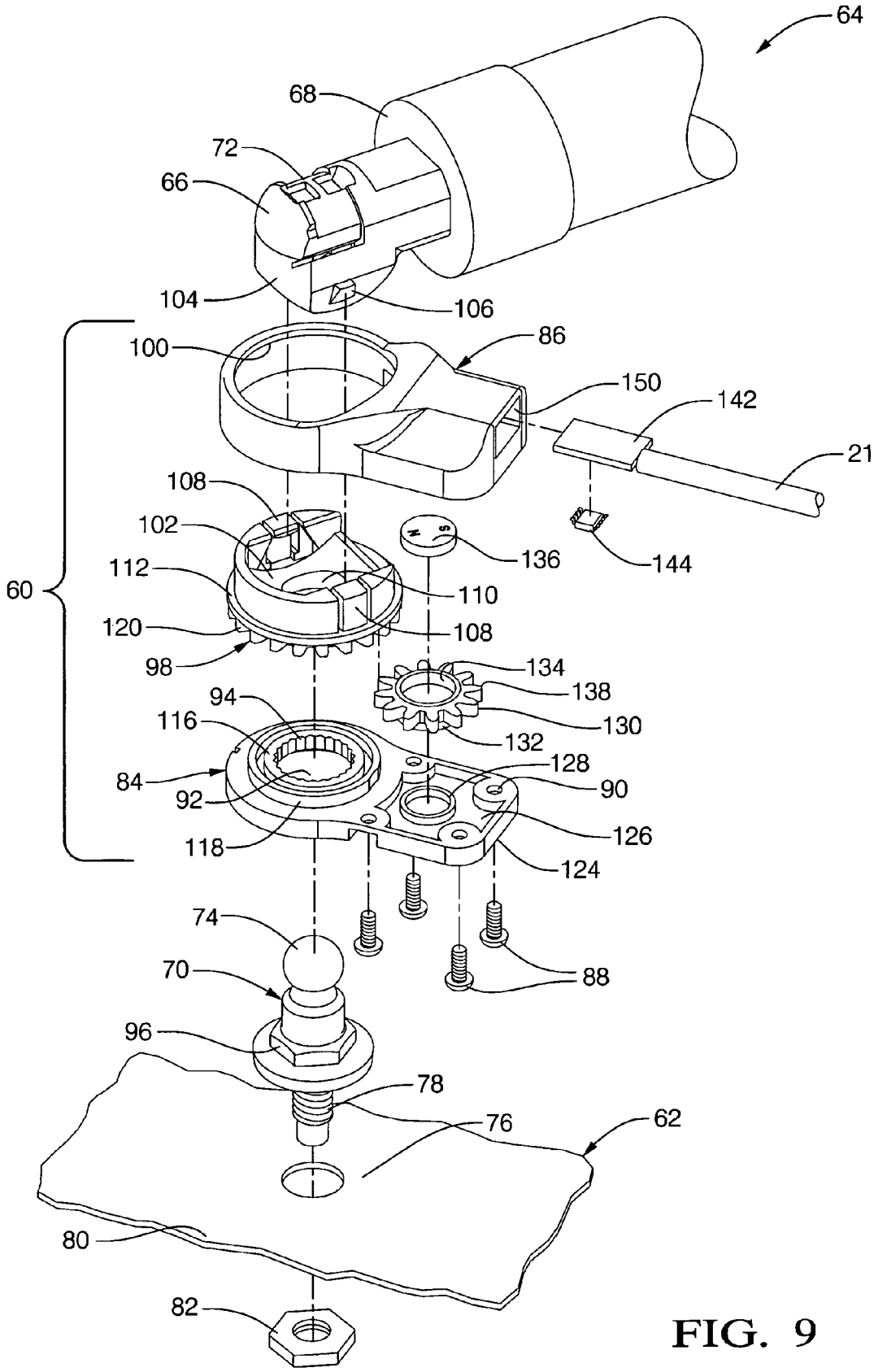
FIG. 9, is an exploded perspective view of the alternative embodiment of FIG. 8.
Figure 10:
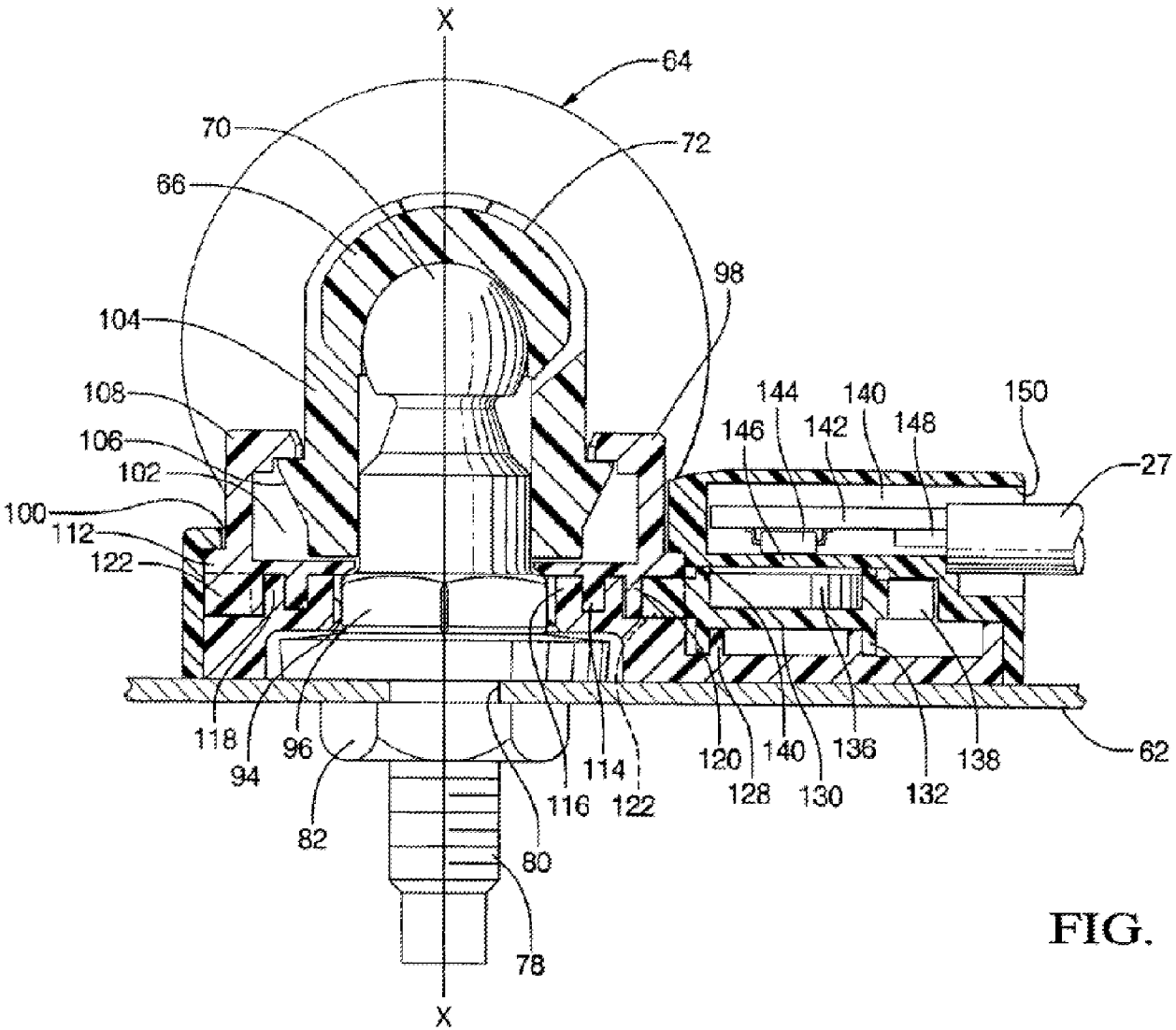
FIG. 10, is a broken, cross-sectional view, on an enlarged scale, of the alternative embodiment of FIG. 8, taken on lines 10-10 of FIG. 8.

Referring to FIGS. 8-10, another alternative embodiment of the present invention is illustrated.

As best viewed in FIG. 9, a position sensor 60 is mountingly interposed between a host vehicle 62 and a jackscrew strut 64. A ball socket 66 extends longitudinally from an adjacent end 68 of the jackscrew strut 64. The ball socket 66 lockingly engages a steel ball stud 70 for limited pivotal freedom of movement therebetween. A spring retainer guideway feature 72 is formed in the ball socket 66. The guideway feature 72 positions and retains a spring retainer (not illustrated) which serves to interconnect the ball socket 66 with a head 74 of the ball stud 70 as is described in related copending U.S. patent application Ser. No. 12/012,505 filed 1 Feb. 2008, the specification of which is incorporated herein by reference.

The ball stud 70 is affixed at a designated mounting location 76 on the outer surface of the vehicle 62 whereby a threaded shank 78 extends through a bore 80 in the mounting location 76 for attachment to a weld nut 82.

The position sensor 60 includes a stator or housing assembly 83 consisting of a base member 84 and a cover member 86 interconnected by suitable fastening means such as screws 88 extending through registering through holes 90 in the base 84 and blind bores (not illustrated) in the underside of the cover 86. It is contemplated that other alternative forms of attachment, such as ultrasonic welding, snap-fit self engaging cooperating integral features, and the like can also be employed.

The base 84 has a through passage 92 forming a plurality of symmetrically circumferentially arranged knurls or serrations 94 dimensioned for slip-fit engagement with hex-head flats 96 integrally formed on the outer surface of the ball stud 70. Upon assembly, the ball stud 70 extends through passage 92 whereupon the knurls 94 engage the radially outwardmost portions of the ball stud flats 96 to rotationally interlock the sensor housing base 84 with the ball stud 70. This allows extremely precise and selective rotational positioning of the position sensor 60 with respect to the ball stud 70, and thus the jackscrew strut 64, at one of a finite number of possible orientations determined by the relative number of knurls 94 and hex-head flats 96 employed. This feature has the advantage of permitting a common design to be employed in many vehicle configurations for both functionality (ex. avoiding interfering with the jackscrew strut through its range of motion) and esthetic reasons. Furthermore, the hex-head flats 96 are dual-purpose, and can be employed by an installation tool (ex. wrench, nut driver or the like) for installing the ball stud onto the weld nut 82.

Referring to FIGS. 9 and 10, a rotor or generally annular yoke 98 is disposed within the position sensor housing 83 and extends upwardly through an opening 100 in housing cover 86. The exposed upper portion of the yoke 98 has a pocket 102 formed therein for receiving a saddle-shaped radial extension 104 of the ball socket 66. A pair of opposed ramped abutment features 106 integrally formed in the radial extension 104 engage cooperating cantilevered engagement members 108 integrally formed in the yoke 98 to maintain engagement between the yoke 98 and the ball socket 66 of the jackscrew strut 64.

The yoke 98 forms a central through passage 110 concentrically disposed and dimensioned to permit the ball stud 70 to extend upwardly therethrough. The yoke 98 has a circumferential flange 112 extending radially outwardly sufficiently to entrap the yoke in assembly within the position sensor housing 83. Yoke 98 has a downwardly extending circumferential guide skirt 114 (refer FIG. 10) integrally formed therewith concentrically with the central through passage 110. In assembly, the yoke guide skirt 114 is in slip-fit juxtaposition radially between concentric inner and outer upwardly extending circumferential guide skirts 116 and 118, respectively, integrally formed on the upper surface of the base member 84. The upper surfaces of the inner and outer guide skirts 116 and 118 serve as axial thrust surfaces. Thus configured, the base member through passage 92, cover member opening 100 and yoke through passage 110 are precisely axially aligned. The yoke is axially and radially constrained within the position sensor housing 83, but is free to rotate with respect thereto about the axis of the ball stud 70.

A yoke gear 120 is integrally formed on the bottom of the yoke 98 radially outwardly of the yoke guide skirt 114. The yoke gear 120 has twenty one (21) symmetrically equally spaced, radially outwardly directed circumferentially equally spaced gear teeth 122.

The position sensor housing 83 has a localized radial extension 124 formed therein defining a substantially closed inner cavity 126. An upwardly extending annular guide skirt 128 is integrally formed within the extension cavity 126. An idler gear 130 is disposed within the cavity 126. The idler gear 130 has a downwardly directed guide skirt 132 integrally formed therewith which is in slip-fit engagement with the cooperating guide skirt 128. The upper surface of the idler gear 130 has a pocket 134 formed therein for nestingly receiving a permanent magnet 136 in a tight interfit to ensure secure fixation therebetween. The permanent magnet is preferably radially polarized.

The idler gear 130 has twelve (12) radially outwardly directed circumferentially equally spaced gear teeth 138. The cover member 86 closely abuts the upper surface of the idler gear 130 whereby, in assembly, the idler gear 130 and permanent magnet 136 are axially and radially retained within the position sensor housing 83 but are free to rotate with respect thereto, subject only to the effect of engagement of the idler gear teeth 138 with the yoke gear teeth 122.

The yoke and idler gears 120 and 130, respectively, are configured to rotate about parallel, spaced axes. The axes of the gears 120 and 130 are arranged, and gear teeth 122 and 138 are shaped and configured, to ensure continuous intermesh therebetween with no backlash. This will result in precise and repeatable positioning of the permanent magnet 136 in response to irregular and bi-directional inputs through the yoke gear 120.

The position sensor cover member 86 has a second, substantially closed cavity 140 formed therein configured for receiving and supporting a substrate such as a printed circuit (PCB) board 142. An analog absolute position sensor 144 is mechanically supported by the PCB 142 within the cavity 140 and is substantially axially aligned with the permanent magnet 136 (and idler gear 130) through an intermediate web 146 to ensure optimum juxtaposition therebetween.

U.S. Pat. No. 7,230,419 B2 to Godoy et al. entitled "Rotary Position Sensor" describes a somewhat analogous application in a rotary position sensor. The specification of U.S. Pat. No. 7,230,419 B2 is incorporated herein by reference.

The PCB 142 also supports any other electronic or semiconductor devices (not illustrated) as well as the power and/or communication link 27 (refer FIG. 1), which can have its conductor(s) directly connected to the PCB 142. Alternately, an external access opening 150 in the cover member 86 can be configured to nestingly receive an electrical connector (not illustrated) which is electrically connected to circuit traces and components on the PCB 142. In such an alternative approach, a mating connector plug from a wiring harness lead would be inserted into the connector.

The base member 84, cover member 86, yoke 98 and idler gear 130 are preferably constructed of non-electrically conductive material such as injection molded plastic.

The position sensor 60, in application, is integrated into one or both of the ball socket connectors 16 interconnecting the jackscrew strut 14 to a designated mounting location 76 on either a movable panel, such as a lift gate 12, carried on a host vehicle 10, or a relatively fixed portion of the host vehicle 10 itself.

The embodiment of the position sensor 60 described herein with respect to FIGS. 8-10 has a first portion which is fixedly supported on the host vehicle 10 (either on a relatively non-movable portion of the vehicle's body) , or on a movable panel such as a lift gate 12, or both. The position sensor 60 has a second portion which is carried for rotation with a jackscrew strut 64. The relative movement or position of the first and second portions is sensed, resulting in an output signal processed by the vehicle ECU to ascertain the instantaneous position of the movable panel.

In FIGS. 8-10, the first sensor portion includes the position sensor housing 83, the PCB 142 the analog absolute position sensor 144 and the electrical output conductors 148, which are all affixed to the vehicle 10. The second sensor portion includes the yoke 98, the idler gear 130 and the permanent magnet 136, which are affixed to and move with the jackscrew strut 64 as it rotates about the axis X-X extending through the ball stud 70. The yoke 98 is guided within the position sensor housing 83 for pure rotation about axis X-X. The yoke 98 is interlocked with the ball socket 66 for limited rotation about axis X-X. Furthermore, the ramped abutment features 106 of the radial extension 104 of the ball socket 66 serve as pivot points in cooperation with the associated engagement members 108 of the yoke 98 whereby the jackscrew strut 64 is free to rock through a limited range of motion as the associated lift gate 12 translates between its full open and full closed positions.

During rotation of the yoke 98 about axis X-X, the yoke gear 120 moves therewith. The yoke gear teeth 122 continuously engage the idler gear teeth 138 to also rotate the idler gear 130 (in a reverse direction) along with the permanent magnet 136. In the preferred embodiment, the yoke gear has 21 teeth and the idler gear has 12 teeth, whereby the idler gear 130 and magnet 136 rotate at approximately twice the rate of the yoke gear 21. This increases the movement of the permanent magnet 136 with respect to the analog position sensor 144 for a given rotational input to the yoke 98, thereby increasing the resolution and accuracy of the sensing function. It is contemplated that the gear ratio between the yoke and idler gears can be varied to accommodate differing vehicle lift gate and strut configurations.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, an electromagnet or other known devices for producing an electric field can be employed in place of the permanent magnet 136. Similarly, other known forms of galvanomagnetic or magnetic field sensing devices could be substituted for the analog absolute position sensor described herein. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

What is claimed is:

1. A position sensor assembly for sensing movement of a drive mechanism, the drive mechanism including an elongated strut having a first end connector pivotably affixed to a frame remote from the drive mechanism and a second end connector pivotably affixed to a movable panel supported on the frame, wherein at least one of the strut connectors includes a fixed portion attached to the frame and a movable portion attached to the strut, the position sensor assembly comprising:

a stator portion adapted for connection to the fixed connector portion;

a rotor portion moveable in response to rotation of the movable connector portion about an axis between first and second different connector portion positions, the stator portion supporting a galvanomagnetic sensing element;

an idler supported on the stator portion and moveable relative to each of the first end connector and the rotor portion, the idler including an idler gear, the idler supporting a magnet juxtaposed in substantially axial alignment with the galvanomagnetic sensing element when the movable connector portion is in each of the first and second positions for magnetic interaction therewith, the galvanomagnetic sensing element generating a sensor output signal indicative of the relative angular position of the movable and fixed connector portions;

the rotor portion comprising a yoke affixed to and movable with the strut, the yoke having a yoke gear integrally formed with the yoke and including a plurality of radially outwardly directed gear teeth; and wherein the stator portion nestingly receives an integral communication assembly including the sensing element, a communication link, and a printed circuit board, and wherein the yoke gear continuously engages the idler gear teeth to magnify the rotation of the idler gear and the magnet.

2. The position sensor assembly of claim 1, wherein magnifying the rotation of the idler gear and the magnet includes rotating the idler gear and the magnet at least twice the rate of the yoke gear.

3. The position sensor assembly of claim 1, wherein the magnet is supported by the idler for movement with the idler.

4. The position sensor assembly of claim 1, wherein the rotor portion rotates relative to the stator portion about a first axis, and wherein the axis along which the galvanomagnetic sensing element and the magnet are aligned is a second axis, the galvanomagnetic sensing element and the magnet being oriented such that rotation of the rotor portion relative to the stator portion about the first axis in a direction causes rotation of one of the galvanomagnetic sensing element and the magnet relative to an other of the galvanomagnetic sensing element and the magnet about the second axis in an opposite direction.

5. The position sensor assembly of claim 1, wherein the axis of rotation defined between the stator portion and the rotor portion is a first axis, and wherein the axis along which the galvanomagnetic sensing element and the magnet are aligned is a second axis, the second axis being spaced from the first axis.

6. The position sensor assembly of claim 1, wherein the axis of rotation defined between the stator portion and the rotor portion is a first axis, and wherein the axis along which the galvanomagnetic sensing element and the magnet are aligned is a second axis, the second axis being substantially parallel to the first axis.

7. A position sensor assembly operable to sense movement of an elongated strut as the elongated strut moves a panel relative to an opening in a frame, the elongated strut including a first end connector rotatably affixed to the frame remote from the moveable panel and a second end connector rotatably affixed to the movable panel, the position sensor assembly comprising:

a stator portion secured against movement relative to the frame; and a rotor portion moveable relative to the frame in response to movement of one of the first end connector and the second end connector;

an idler supported on the stator portion and moveable relative to each of the first end connector and the rotor portion, the idler including an idler gear;

the rotor portion comprising a yoke affixed to and movable with the strut, the yoke having a yoke gear integrally formed with the yoke and including a plurality of radially outwardly directed gear teeth;

a magnet supported on the idler; and a galvanomagnetic sensing element driven by the rotor portion such that rotational movement of the panel relative to the frame in a first rotational direction causes rotational movement of the rotor portion in a second rotational direction relative to the stator portion, the second rotational direction being opposite to the first rotational direction, the galvanomagnetic sensing element producing a sensor output signal indicative of the relative angular position of the magnet and the galvanomagnetic sensing element which corresponds to a relative angular position of the stator portion and the moveable portion;

wherein the sensing element, a printed circuit board, and a communication link are jointly and integrally inserted into a recess defined in the stator portion, and wherein the yoke continuously engages the idler gear to increase the rotation of the idler gear and the magnet.

8. The position sensor assembly of claim 7, wherein the rotor portion is moveable relative to the frame in response to movement of one of the first end connector and the second end connector about an axis between first and second different connector portion positions, wherein, when the rotor is in each of the first and second positions, the galvanomagnetic sensing element and the magnet are juxtaposed in substantially axial alignment for magnetic interaction.

9. The position sensor assembly of claim 7, wherein increasing the rotation of the idler gear and the magnet includes rotating the idler gear and the magnet at least twice the rate of the yoke gear.

10. The position sensor assembly of claim 7, wherein the magnet is supported by the idler for movement with the idler.

11. The position sensor assembly of claim 7, wherein the rotor portion rotates relative to the stator portion about a first axis, and wherein the galvanomagnetic sensing element and the magnet are aligned along a second axis spaced from the first axis.

12. The position sensor assembly of claim 7, wherein the rotor portion rotates relative to the stator portion about a first axis, and wherein the galvanomagnetic sensing element and the magnet are aligned along a second axis, the second axis being substantially parallel to the first axis.

13. A position sensor assembly operable to sense movement of an elongated strut as the elongated strut moves a panel relative to an opening in a frame, the elongated strut including a first end connector pivotably affixed to the frame remote from the moveable panel and a second end connector pivotably affixed to the movable panel, the position sensor comprising:

a stator portion secured to the frame;

a rotor portion rotatable about a first axis with one of the first end connector and the second end connector relative to the frame and the stator portion;

an idler supported on the stator portion and moveable relative to each of the first end connector and the rotor portion, the idler including an idler gear;

the rotor portion comprising a yoke affixed to and movable with the strut the yoke having a yoke gear integrally formed with the yoke and including a plurality of radially outwardly directed gear teeth; and a magnet supported on the idler and a galvanomagnetic sensing element supported on the stator portion, the magnet and the galvanomagnetic sensing element being rotatable about a second axis relative to the galvanomagnetic sensing element, the second axis being substantially parallel to the first axis, the galvanomagnetic sensing element being operable to produce a sensor output signal indicative of the relative angular position of the magnet and the galvanomagnetic sensing element which corresponds to a relative angular position of the stator portion and the moveable portion;

wherein the sensing element, a printed circuit board, and a communication link are together integrally nested in a recess defined in the stator portion, and wherein the yoke gear continuously engages the idler gear teeth to boost the rotation of the idler gear and the magnet.

14. The position sensor assembly of claim 13, further comprising means operative to increase angular displacement of the magnet.

15. The position sensor assembly of claim 13, wherein the means operative to increase angular displacement of the magnet includes a gear set interconnecting the rotor portion and the magnet.

16. The position sensor assembly of claim 13, wherein the rotor portion is moveable relative to the frame in response to movement of one of the first end connector and the second end connector about an axis between first and second different connector portion positions, wherein, when the rotor is in each of the first and second positions, the galvanomagnetic sensing element and the magnet are juxtaposed in substantially axial alignment for magnetic interaction.

17. The position sensor assembly of claim 13, wherein boosting the rotation of the idler gear and the magnet includes rotating the idler gear and the magnet at least twice the rate of the yoke gear.

18. The position sensor assembly of claim 13, wherein the magnet is supported by the idler for movement with the idler.

* * * * *